US010487509B2

(12) United States Patent
Tokdemir et al.

(10) Patent No.: US 10,487,509 B2
(45) Date of Patent: Nov. 26, 2019

(54) METHOD FOR PRODUCING A COVERING ELEMENT MADE FROM FIBERS IMPREGNATED WITH BITUMEN HAVING IMPROVED FIRE PROPERTIES, AND COMPOSITION

(71) Applicants: ONDULINE, Levallois-Perret (FR); ONDULINE, Levallois-Perret (FR)

(72) Inventors: Eyup Tokdemir, Izmit (TR); Ethem Sakioglu, Istanbul (TR); Andac Guzel, Levallois-Perret (FR)

(73) Assignee: ONDULINE, Levallois-Perret (FR)

( * ) Notice: Subject to any disclaimer, the term of this patent is extended or adjusted under 35 U.S.C. 154(b) by 479 days.

(21) Appl. No.: 15/115,072

(22) PCT Filed: Jan. 22, 2015

(86) PCT No.: PCT/FR2015/050159
§ 371 (c)(1),
(2) Date: Jul. 28, 2016

(87) PCT Pub. No.: WO2015/114239
PCT Pub. Date: Aug. 6, 2015

(65) Prior Publication Data

US 2016/0356046 A1 Dec. 8, 2016

(30) Foreign Application Priority Data

Jan. 28, 2014 (FR) ..... 14 00213

(51) Int. Cl.
*E04D 3/32* (2006.01)
*E04D 3/34* (2006.01)
(Continued)

(52) U.S. Cl.
CPC ..... *E04D 3/32* (2013.01); *D06N 5/003* (2013.01); *E04D 3/34* (2013.01); *E04D 5/02* (2013.01);
(Continued)

(58) Field of Classification Search
CPC .... E04D 3/32; E04D 3/34; E04D 5/02; D06N 5/003; D06N 2209/067; D06N 2209/0823
See application file for complete search history.

(56) References Cited

U.S. PATENT DOCUMENTS 5,173,515 A 12/1992 von Bonin et al.
2005/0145139 A1* 7/2005 Khan ..... C04B 26/02 106/437
(Continued)

FOREIGN PATENT DOCUMENTS

EP 2 617 894 A1 7/2013
EP 2 634 306 A1 9/2013
FR 2 372 927 A1 6/1978

OTHER PUBLICATIONS

International Search Report, dated Jun. 1, 2015, from corresponding PCT Application.

*Primary Examiner* — Robert J Grun
(74) *Attorney, Agent, or Firm* — Young & Thompson

(57) ABSTRACT

A method for producing a covering element made from natural fibres, in particular cellulose, impregnated with bitumen, includes a step of coating at least one of two faces of a fibre mat (4) followed by a step of impregnating with bitumen, the coating being carried out with a liquid composition (5) including at least one resin and/or at least one pigment. The liquid composition is a dye composition including at least one pigment and at least one resin, and the method involves adding an additive to the liquid composition (5), the additive having fireproof properties and including at least graphite and a cooling agent. Preferably, the mat
(Continued)

(4) is coated with the liquid composition including the fireproof additive using a roller.

9 Claims, 1 Drawing Sheet

(51) Int. Cl.
*D06N 5/00* (2006.01)
*E04D 5/02* (2006.01)

(52) U.S. Cl.
CPC ..... *D06N 2209/067* (2013.01); *D06N 2209/0823* (2013.01)

(56) References Cited

U.S. PATENT DOCUMENTS

| | | | |
|---|---|---|---|
| 2013/0186033 | A1 | 7/2013 | Thomas et al. |
| 2014/0013639 | A1 | 1/2014 | Polovnev et al. |
| 2014/0013693 | A1 | 1/2014 | Zhou et al. |
| 2014/0072765 | A1 | 3/2014 | Martin et al. |

* cited by examiner

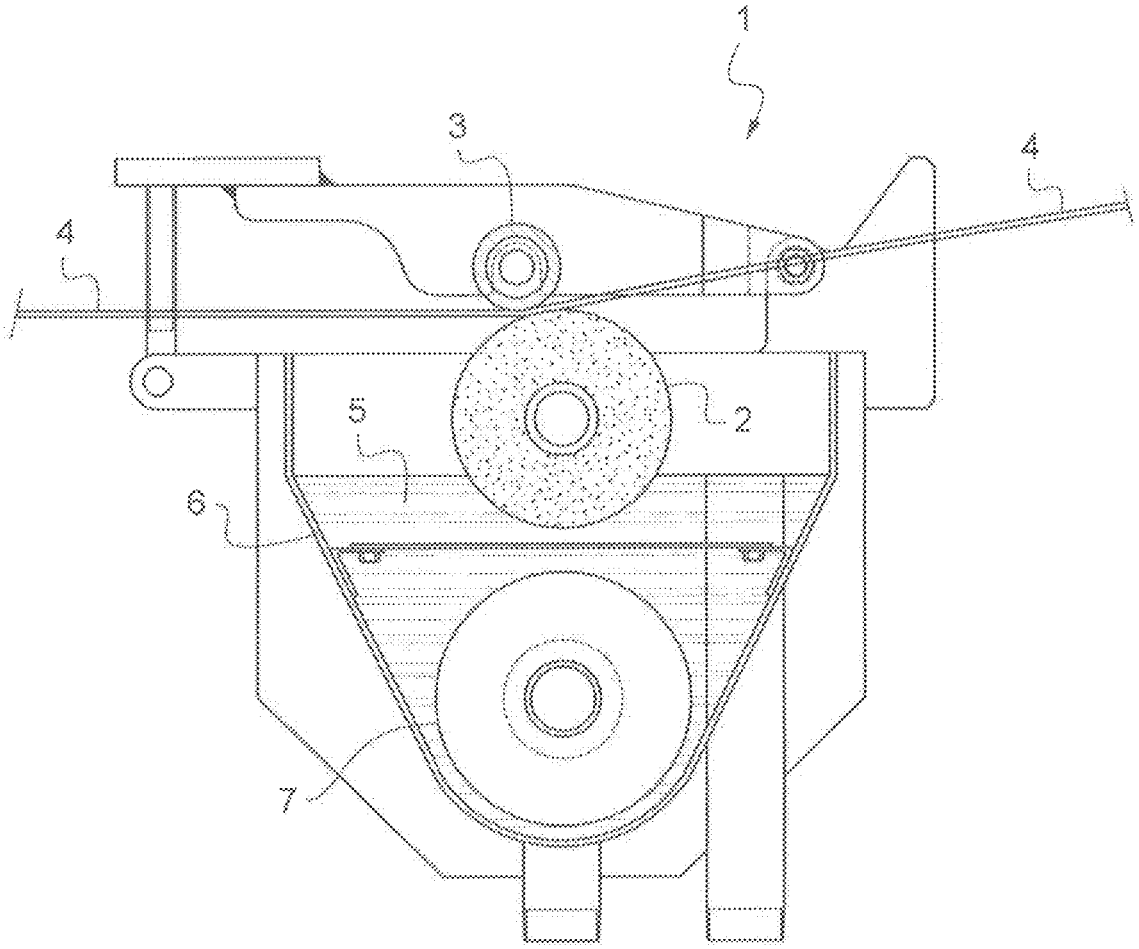
1
3
4
4
2
5
6
7

METHOD FOR PRODUCING A COVERING ELEMENT MADE FROM FIBERS IMPREGNATED WITH BITUMEN HAVING IMPROVED FIRE PROPERTIES, AND COMPOSITION

The present invention relates to a method for producing a roof covering element made of fibres, in particular cellulose fibres, impregnated with bitumen, which as an improved fire behaviour, a device for the implementation of the method, as well as a composition usable for that purpose. It has applications in the field of manufacturing of construction elements, and in particular roofing elements, in particular corrugated sheets or other roofing elements, including those covering lines or singular points of the roofs.

The bitumen-impregnated cellulose-fibre roofing elements are used from many years. In order to improve their fire behaviour, it has been proposed to use graphite in their composition. In particular, it has been proposed to use dry spreading: dusting of graphite particles over one of the two opposite faces of the roofing elements with a means allowing said particles to remain integral with said surface.

The equipment required for making such an operation is complex and delicate to adjust given that the particles are spread, either on elements caused to be shaped, or on already-shaped elements, in particular corrugated sheets, making it difficult to perform a homogeneous spreading over the whole surface. Moreover, this is a specific equipment, dedicated to the spreading of particles of graphite and that may be difficult to install within an already-existing production line.

The document FR2372927 is known, which describes a method of manufacturing hardly-combustible bitumen-impregnated corrugated sheets, in which an aqueous composition of specific formulation is poured or sprayed, but which does not mention graphite. The document EP2617894 describes a fire-resistant, bitumen-impregnated, cellulosic roofing sheet, and a manufacturing method, in which graphite is dry-deposited on a mat covered with an adhesive primary layer. The document EP2634306 describes a protective membrane and the method of manufacturing thereof, in which the membrane is first soaked in bitumen, then receives particles.

It is herein proposed a method of spreading graphite incorporated in a liquid composition and a corresponding device, which may be easily combined with existing method and equipment of a line of production of roofing elements made of fibres, in particular bitumen-impregnated cellulose. It is more specifically proposed to use them within an equipment intended for dying the roofing element, i.e. within an already-existing equipment, i.e. at the time of installation of a new line of production of roofing elements.

The invention has hence for object a method for producing a bitumen-impregnated, fibre roofing element, including a step of coating at least one of two faces of a fibre mat, said fibres being at least, for a part of them, natural fibres, said natural fibres being in particular cellulose fibres, followed by a step of impregnating with bitumen, the coating being carried out with a liquid composition including at least one resin and/or at least one pigment.

According to the invention, it is added to the liquid composition an additive having fireproof properties and including at least graphite and a cooling agent.

In various embodiments of the invention, the following means, which can be used alone or in any technically possible combination, are used:

the liquid composition is a dye composition including at least one pigment and at least one resin, and it is added to the liquid composition an additive having fireproof properties and comprising at least graphite and a cooling agent.

the step of coating the fibre mat is carried out before the impregnation with bitumen, the fibres are all natural fibres, the natural fibres include cellulose fibres, the natural fibres are practically all cellulose fibres, the fibres are cellulose fibres, the cellulose comes from recycled papers and/or cardboards, the liquid composition includes at least one resin, the liquid composition includes at least one pigment so as to form a dye composition, the liquid composition further includes, in addition to the resin, at least one pigment so as to form a dye composition, preferably, the liquid composition is a dye composition including at least one pigment and at least one resin, the fibre mat is a planar/flat mat, the cooling agent is colemanite, the fireproof additive includes only graphite and colemanite, a fireproof additive is implemented, in which the cooling agent is colemanite, the at least one resin is chosen among: epoxide resins, polyurethane resins, polyurea resins, polyurea-formaldehyde resins, melamine-formaldehyde resins, epoxyvinylester resins or vinylester resins, the at least one pigment is chosen among: the metal oxides such as iron oxide and chromium oxide, it is implemented a liquid composition including the fireproof additive that includes at least one resin chosen among: epoxide resins, polyurethane resins, polyurea resins, polyurea-formaldehyde resins, melamine-formaldehyde resins, epoxyvinylester resins or vinylester resins, and the liquid composition, in the case where it is a dye composition, including the fireproof additive, includes at least one pigment chosen among: the metal oxides, such as iron oxide and chromium oxide, the coating is carried out according to determined procedural modalities and with determined proportions of the compounds of the liquid composition so as to obtain a roofing element having determined weights of said compounds, the quantity of resin represents from 0.5 to 3% in weight of the roofing element, the quantity of pigment represents from 0.5 to 3% in weight of the roofing element, the quantity of cooling agent represents from 1 to 7% in weight of the roofing element, the quantity of cooling agent preferably represents from 2 to 5% in weight of the roofing element, the quantity of graphite represents from 1 to 7% in weight of the roofing element, the quantity of graphite preferably represents from 2 to 5% in weight of the roofing element, the quantity of resin represents from 0.5 to 3% in weight of the roofing element, the quantity of pigment represents from 0.5 to 3% in weight of the roofing element, the quantity of cooling agent preferably represents from 1 to 7% in weight of the roofing element, and the quantity of graphite represents from 1 to 7% in weight of the roofing element, the graphite is in the form of scales or flakes, the scale or flake graphite has a size range chosen between 70 Mesh and 220 Mesh, i.e. between 210 mm and 62 mm, the coating of the mat with the liquid composition including the fireproof additive is carried out with a roll, the coating of the mat is a roll coating of the liquid composition including the fireproof additive, the coating of the mat is a coating with a blade or a scraper of the liquid composition including the fireproof additive, the coating of the mat is a coating by spraying of the liquid composition including the fireproof additive, the liquid composition including the fireproof additive intended to be coated on the mat is kept under constant agitation by an agitator, the constant agitation of the liquid composition including the fireproof additive relates to the composition stored in a coating vessel in which the coating roll is soaked/steeped, the constant agitation of the liquid composition including the fireproof additive relates to the composition stored in a system of storage and/or preparation of said composition, distinct from the coating vessel, the agitator is a vibratory agitator arranged on the wall of the coating vessel, in particular based on sound or ultrasound vibrations, the agitator is a mechanical agitator placed within the liquid composition, the agitator is chosen among the Archimedean screw agitator, helical ribbon agitator or any other equivalent type of agitator, the method further includes a step of drying and setting of the liquid composition including the fireproof additive that has been coated on the mat, the fibre mat is discontinuous and corresponds to fibre sheets, the fibre mat is continuous, said mat being cut into sheets in a step of segmentation posterior to the step of coating and anterior to the step of impregnation with bitumen, the impregnation with bitumen being carried out on individual sheets, the method further includes a step of shaping the mat after the step of coating and before the step of impregnation with bitumen, the step of shaping is a step of making corrugations in a roll corrugator, it is implemented at least one coating roll and one coating vessel for the liquid composition including the fireproof additive, said at least one coating roll soaking within the coating vessel in said liquid composition including the fireproof additive and said coating vessel includes said agitator intended to keep under constant agitation said composition including the fireproof additive.

The invention also relates to a device for coating a fibre mat, said fibres being, at least for a part of them, natural fibres, said natural fibres being in particular cellulose fibres, and which is specially intended to be implemented in the method presented and which includes at least one coating roll and one coating vessel for a liquid composition including a fireproof additive, said at least one coating roll soaking within the coating vessel in said liquid composition including the fireproof additive and said coating vessel includes an agitator intended to keep under constant agitation said liquid composition including the fireproof additive. In particular embodiments, the agitator is of the Archimedean screw type and/or the agitator and said at least one coating roll have parallel axes of rotation. Preferably, the liquid composition is a dye composition.

The invention also relates to a liquid composition including a fireproof additive for implementing the method presented, and such that it includes, for the liquid composition part, at least one resin and, possibly, one or several pigments, and for the fireproof additive part, graphite and a cooling agent. In particular, the cooling agent is colemanite.

The invention also relates, in itself, to a step of coating a fibre mat, said fibres being at least, for a part of them, natural fibres, said natural fibres being in particular cellulose fibres, by a liquid composition including a fireproof additive according to the described invention. In a variant, a step of drying/setting of the liquid composition including the fireproof additive that has been coated on the mat is added thereto.

Thanks to the invention, the manufacture of the roofing elements is simplified because it is obtained in only one operation the dying with the dye composition including at least one pigment and at least one resin and the protection against fire because the composition also includes graphite and a cooling agent, the whole being carried out by a wet method with a roll coating. The implementation of rolls allows a controlled application of the composition with a certain pressure, which leads to a better setting/incorporation of the elements of the composition into the fibre mat, in particular scales or flakes of graphite. The roll coating also allows contemplating the making of particular coloured patterns on the mat.

The present invention will now be exemplified, without being limited thereby, by the following description of embodiments and implementations in relation with:

FIG. 1, which shows a device for coating a mat of natural fibres that are herein cellulose fibres.

The coating device 1 of FIG. 1 is especially configured for the implementation of the method of the invention, because it allows a homogeneous coating of a liquid composition 5 including a fireproof additive thanks to the coating roll 2 that is soaked/steeped in part in said composition 5. The liquid composition 5 including the fireproof additive is contained in a coating vessel 6 of the device 1 and is kept under constant agitation by an agitator 7, so that said composition remains substantially homogeneous. The axes of rotation of the coating roll 2 and of the agitator 7 are parallel to each other. A counter-roll 3 presses the mat 4 of cellulose fibres against the coating roll 2. Means for adjusting and regulating the pressure of the counter-roll are implemented.

In this example, the cellulose fibres are in the form of a continuous mat of cellule fibres that runs continuously between the coating roll 2 and the counter-roll 3.

The liquid composition 5 including the fireproof additive comes preferably from a not-shown upstream system of storage and/or preparation for said composition and the device includes means for transferring and regulating the level of the liquid composition 5 in the coating vessel 6. Among the means for adjusting the quantity of liquid composition 5 including the fireproof additive that is deposited on the mat of cellulose fibres and that is hence in the finite product, it can be mentioned the adjustment of the level of liquid composition 5 in the coating vessel 6 making that the coating roll 2 is more or less steeped in the liquid composition.

A loop circulation is advantageously implemented between the coating vessel 6 and the upstream system of storage and/or preparation. The upstream system includes means for preparing the liquid composition 5 including the fireproof additive with a mixer allowing mixtures at different speeds. A low-pressure positive displacement pump is implemented between the storage and/or preparation system and the coating vessel 6.

Typically, a liquid composition 5 such as a dye composition including the fireproof additive by firstly mixing pigment in water in a mixer with a high speed of mixing.

Preferably, surfactant agents are added so as to facilitate the mixture between the water and the pigment(s). Then, colemanite is added, in the mixer still at high speed of mixing, preferably by progressive adding of the colemanite. Once this previous mixture made, the graphite is progressively added, this time at a lower speed of mixing. Then, one or several compatible resins are added, at this lower speed of mixing or at a still lower speed of mixing. During these phases, the viscosity and/or other parameters are, if necessary, adjusted. For that purpose, it may be act on the quantities of product implemented, in particular water, pigment(s), resin(s) and/or other products may be added. It is to be noted that, in other embodiments of making a liquid composition including the fireproof additive, the order and/or the way to incorporate the compounds in the mixture may be different.

The colemanite is a cooling agent, i.e. this is a substance that avoids a too high elevation of heat of the fibre mat when the latter is heated. Indeed, in itself, the graphite is a heat conductor. Now, during the operation of drying of the fibre mat after coating, the mat is heated to eliminate the water/humidity remaining in the mat. Indeed, the viscous solution containing among other things the graphite is applied on the mat whereas it still contains a certain humidity. This heating for drying, which also allows the setting/drying of the coating liquid composition, will hence also heat the graphite, and the temperature of the graphite in contact with the fibre mat risks to cause an over-heating of these fibres and hence a risk of damaging of the fibres. The cooling agent has hence for role to control the temperature at the level of the fibre mat thanks to the release of water molecules in the case of the colemanite.

It is hence understood that a cooling agent, within the framework of the invention, may correspond to a substance that, by a physicochemical reaction, causes a lowering of the temperature, vaporisation of the water in the case of the colemanite, and/or by a physical effect, limits the transmission of heat by barrier and/or reflexion effect.

The liquid composition including the fireproof additive that is coated on the mat is preferably as a liquid form of determined fluidity to allow a part of said liquid composition including the fireproof additive to be able to diffuse at least in part in the thickness of the mat of cellulose fibres. Hence, the liquid composition including the fireproof additive impregnates, at least in part, the thickness of the mat in addition to covering in surface at least one of the two faces of the mat of cellulose fibres. Preferably, a single one of these two faces of the mat of cellulose fibres is coated with the liquid composition including the fireproof additive. In a variant of implementation, the liquid composition including the fireproof additive may be of a more pasty consistency, with an application by a blade or a scraper on the mat of cellulose fibres.

The graphite implemented has determined ranges of particle sizes and shapes and, preferably, graphite in the form of scales or flakes that remain essentially at the surface of the mat of cellulose fibres and that diffuse a little in its thickness is implemented.

In particular, the graphite is chosen, in particular in shape/structure and/or size, as well as the operational parameters of the method for producing roofing elements, so that it remains in suspension in the liquid composition until the moment of its application and that it remains inert during the drying after the coating and the impregnation with bitumen. It is indeed preferable that there is no expansion of the graphite before the end of the method for producing roofing elements.

With respect to methods of dry deposition of graphite, the method of the present invention may allow a more or less important diffusion of the graphite in the thickness of the mat of cellulose fibres if it is desired by modifying the size and/or the form of the graphite used.

After coating of the mat of cellulose fibres by the liquid composition including the fireproof additive, the mat is dried in a drying oven which allows both the setting/cross-linking of the liquid composition including the fireproof additive and the elimination of the water/humidity liable to be still contained in the mat. The drying oven is at a temperature comprised between 150° C. and 400° C. and, preferably, comprised between 200° C. and 300° C. Indeed, for a hot impregnation with bitumen of the cellulose fibres, preferably then in the form of sheets and no longer in the form of a continuous mat, it is desirable that the mat or the sheets are essentially dry.

Generally, after coating with the liquid composition including the fireproof additive, the mat of cellulose fibres is shaped during a mat shaping step in order, for example, to make corrugations, and is then passed in the drying oven. It may however be provided a specific means of drying/setting of the liquid composition including the fireproof additive, different from the drying oven, between the coating and the shaping. After drying in the drying oven, the mat of cellulose fibres is cut into sheets and those sheets are then hot impregnated with bitumen. Until the cutting of the mat into sheets, the process is continuous, the mat of cellulose fibres running continuously for the steps of coating, shaping and drying in the drying oven.

The invention claimed is:

1. A method for producing a bitumen impregnated, fibre roofing element, comprising:

coating at least one of two faces of a fibre mat, said fibre mat comprising at least, in part cellulose fibres, and impregnating with bitumen, the coating being carried out with a liquid composition including at least one resin and at least one pigment, wherein the liquid composition is a dye composition including at least one pigment and at least one resin, and wherein added to the liquid composition is an additive having fireproof properties and including at least graphite and colemanite, and wherein the fibre mat is continuous, said mat being cut into sheets in a step of segmentation posterior to the step of coating and anterior to the step of impregnation with bitumen, the impregnation with bitumen being carried out on individual sheets.

2. The method according to claim 1, wherein the graphite is in the form of scales or flakes.

3. The method according to claim 2, wherein:

the at least one resin is chosen among: epoxide resins, polyurethane resins, polyurea resins, polyurea-formaldehyde resins, melamine-formaldehyde resins, epoxyvinylester resins or vinylester resins, and the at least one pigment is chosen among: iron oxide and chromium oxide.

4. The method according to claim 1, wherein the quantity of resin represents from 0.5 to 3% in weight of the roofing element, the quantity of pigment represents from 0.5 to 3% in weight of the roofing element, the quantity of cooling agent preferably represents from 1 to 7% in weight of the roofing element, and the quantity of graphite represents from 1 to 7% in weight of the roofing element.

5. The method according to claim 1, further including a step of drying and setting of the liquid composition including the fireproof additive that has been coated on the mat.

6. The method according to claim 1, further including a step of shaping the mat after the step of coating and before the step of impregnation with bitumen.

7. The method according to claim 1, wherein the liquid composition including the fireproof additive intended to be coated on the mat is kept under constant agitation by an agitator.

8. The method according to claim 7, wherein the coating of the mat (4) with the liquid composition including the fireproof additive is carried out with a roll.

9. The method according to claim 8, wherein the method is implemented with at least one coating roll (2) and one coating vessel (6) for the liquid composition (5) including the fireproof additive, said at least one coating roll soaking within the coating vessel (6) in said liquid composition including the fireproof additive and in that said coating vessel (6) includes said agitator (7) intended to keep under constant agitation said composition (5) including the fireproof additive.

* * * * *